US008733536B2

(12) United States Patent
Klabisch et al.

(10) Patent No.: US 8,733,536 B2
(45) Date of Patent: May 27, 2014

(54) TRANSFER STATION

(75) Inventors: Adam Klabisch, Dortmund (DE); Norbert Hesse, Bochum (DE); Gerhard Siepenkort, Lunen (DE); Klaus Duhnke, Werne (DE); Diedrich Bettermann, Unna (DE)

(73) Assignee: Bucyrus Europe GmbH, Lunen (DE)

( * ) Notice: Subject to any disclaimer, the term of this patent is extended or adjusted under 35 U.S.C. 154(b) by 33 days.

(21) Appl. No.: 13/509,034

(22) PCT Filed: Nov. 5, 2010

(86) PCT No.: PCT/IB2010/055026

§ 371 (c)(1),
(2), (4) Date: May 10, 2012

(87) PCT Pub. No.: WO2011/058485

PCT Pub. Date: May 19, 2011

(65) Prior Publication Data

US 2012/0234650 A1 Sep. 20, 2012

(30) Foreign Application Priority Data

Nov. 13, 2009 (DE) ..... 20 2009 013 727 U

(51) Int. Cl.
*B65G 15/24* (2006.01)

(52) U.S. Cl.
USPC ..... 198/605; 198/599; 198/606; 299/34.1

(58) Field of Classification Search
USPC ..... 198/586, 834, 599; 299/43
See application file for complete search history.

(56) References Cited

U.S. PATENT DOCUMENTS

| | | | | |
|---|---|---|---|---|
| 4,154,479 | A * | 5/1979 | Braun et al. | 299/34.1 |
| 4,300,673 | A * | 11/1981 | Von Viebahn et al. | 198/611 |
| 5,161,671 | A * | 11/1992 | Wleklinski et al. | 198/606 |
| 8,365,901 | B2 * | 2/2013 | Schmidt et al. | 198/735.6 |
| 8,490,779 | B2 * | 7/2013 | Schurer et al. | 198/834 |

FOREIGN PATENT DOCUMENTS

| | | |
|---|---|---|
| DE | 26 59 855 A1 | 8/1977 |
| DE | 35 21 793 A1 | 1/1987 |
| DE | 36 07 212 A1 | 9/1987 |

OTHER PUBLICATIONS

English Translation of International Preliminary Report on Patentability, dated Aug. 7, 2012 in corresponding International Application No. PCT/IB2010/055026, Filed Nov. 5, 2010.

* cited by examiner

*Primary Examiner* — Ramya Burgess
*Assistant Examiner* — Thomas Randazzo
(74) *Attorney, Agent, or Firm* — Foley & Lardner LLP

(57) ABSTRACT

A transfer station in the face end region between a face conveyor and a gate conveyor in the region of a drive for the face conveyor, the gate conveyor being attached to the face conveyor such that it can be moved pivotably to a limited extent relative to the latter. The transfer station being provided with a receiving plate that is arranged on a subframe of the drive for the face conveyor, which receiving plate is provided with a bearing seat, in which a specific connection pan element of the gate conveyor is mounted such that it can be moved pivotably relative to the face conveyor or its drive about a pivot axis which is defined by the bearing seat. The construction has the particular advantage that the pivoting bearing is readily accessible and has to transmit only low forces which result substantially from the loading of the gate conveyor.

20 Claims, 3 Drawing Sheets

TRANSFER STATION

The invention relates to a transfer station in the face end region between a face conveyor and a gate or transfer conveyor in mining for use in the region of a drive for the face conveyor, with the gate or transfer conveyor being attached to the face conveyor such that it is pivotably movable to a limited extent relative to the latter.

BACKGROUND OF THE INVENTION

In the extraction of coal, ore or other extraction products in longwall mining, the broken ground which is released in the longwall face at the breast by the longwall machine is transferred to a face conveyor, generally a scraper chain conveyor, and is transported by the latter through the longwall face as far as the end of the longwall face, where the longwall face opens into the gate which is drifted approximately at right angles to said longwall face. The broken ground is transferred there to a gate conveyor which is arranged in the gate, either directly or with the aid of a short transfer conveyor which extends parallel and next to the gate conveyor and which can participate in the advancing of the extraction and conveying devices in the longwall face during the proceeding extraction, at any rate over a limited length. Since the angular position of the face conveyor relative to the gate or transfer conveyor which is arranged in the gate can likewise change as a result of variable extraction conditions, the gate or transfer conveyor is attached to the face conveyor such that it can be moved pivotably to a limited extent relative to the latter about an axis which is arranged approximately perpendicularly with respect to the footwall. This is realized in the case of a face end which is realized by the applicant by way of a support, designed as a pivot mounting, for the end-side (main) drive station of the face conveyor, the lower part of the pivot mounting being supported on the footwall in the gate and having a lateral connection for the transfer or gate conveyor which is then situated below the delivery region of the face conveyor, in the state in which it is mounted on the pivot mounting.

Although the known solution has proven itself in practice, it is comparatively complicated and expensive, since the great support forces in the region of the (main) drive of the face conveyor have to be absorbed by way of the pivot mounting and have to be dissipated into the footwall in the gate, by which the pivotable mobility between the two conveyors may not be impaired. The axial bearing has to be of correspondingly large dimensions, in order to ensure the rotary mobility of the face conveyor drive relative to the lower part of the pivot mounting.

SUMMARY OF THE INVENTION

It is an object of the invention to provide a transfer station of the type defined in the introduction, which transfer station is simpler and less expensive than the solution which is realized in the prior art.

This object and others achieved by the invention by virtue of the fact that a receiving plate is arranged on a subframe of the drive for the face conveyor, which receiving plate is provided with a bearing seat, in which a connection pan element of the gate conveyor is mounted such that it can be moved pivotably relative to the face conveyor or its drive about a pivot axis which is defined by the bearing seat.

In contrast to the above-described prior art, the face conveyor drive is therefore not supported in the invention on the footwall of the gate such that it can be moved pivotably via a pivot mounting/a subframe about a substantially vertical axis, but rather the pivotable mobility of the gate or transfer conveyor relative to the face conveyor is achieved by a special connection pan element which is received in a pivotably movable manner in the bearing seat of the receiving plate which is arranged laterally on the subframe which supports the drive of the face conveyor. The pivotably movable mounting of the special connection pan element in the bearing seat of the receiving plate can be realized substantially more simply and less expensively, since the bearing forces which are to be transmitted here and result substantially from the weight of the convection pan element and the broken ground which is conveyed in the region of the connection pan element are considerably lower than the load which results from the face conveyor drive and has to be dissipated from the subframe of the latter into the footwall.

The bearing seat is preferably formed substantially by a bearing bore which is formed in the receiving plate and into which a bearing journal engages which is arranged on the underside of the connection pan element. The arrangement is expediently such that the connection pan element which is mounted on the receiving plate is secured against the bearing journal being raised out of the bearing bore, which can be effected, for example, in one advantageous development of the invention by virtue of the fact that the connection pan element is provided with at least one retaining flange which projects laterally and/or radially from the bearing journal and is engaged over with play by a locking bar which is arranged preferably releasably on the receiving plate. In this way, the connection pan element is secured in a positively locking manner against being raised out of the bearing bore, the locking bars coming into contact with the retaining flange as a consequence of the provided lack of play only when the connection pan element protrudes to an extent out of the bearing bore, and then suppress a further movement in the axial direction of the bearing journal. As a rule, the locking bar lies a little above the retaining flange, with the result that no influencing occurs of the rotary mobility between the connection pan element and the receiving plate as a consequence of friction between the locking bars and the retaining flange. Furthermore, it is advantageous in this context if the at least one retaining flange has a preferably central crown, from which it tapers obliquely inward on both sides in the direction of the ends of the connection pan element, that is to say the retaining flange is designed in the manner of an obtuse arrowhead. This arrangement reliably ensures the rotary and/or pivotable mobility of the connection pan element in the receiving plate.

It is advantageous if the locking bar is fastened releasably to the receiving plate, which can preferably take place by means of fastening screws or pins which can be attached to keyhole receptacles on the receiving plate, penetrate the locking bar and clamp it against the receiving plate by means of closing nuts. As a result of this arrangement, the locking bar can be dismantled simply and quickly, in order, for example for maintenance or repair purposes, to dismantle the connection pan element from the receiving plate and to replace it with an exchange part.

It is also advantageous if the connection pan element is provided on the underside with support sliding elements which are arranged spaced apart from the bearing journal, by way of which the connection pan element rests in a slideably manner on the receiving plate. Said support sliding elements can be, in particular, support strips which extend transversely with respect to the longitudinal direction of the gate or transfer conveyor. The support sliding elements additionally aid the pivotable mobility between the connection pan element and the receiving plate.

In one particularly advantageous development of the invention, the connection pan element is provided with an inspection opening which provides access to the lower run of the gate or transfer conveyor and can be closed by means of a covering plate which can be pushed in from one pan side. Here, the covering plate is preferably guided laterally in guide rails which are preferably approximately V-shaped in section and in which said covering plate can slide reliably while it is being pushed in or out.

In the state in which it is mounted on the connection pan element, the covering plate advantageously projects on both sides beyond lateral bounding profiles of the pan element and is provided with stop openings at the projecting regions, and preferably laterally projecting locking lugs which are aligned with the stop openings are arranged on the bounding profiles, it being possible, for locking purposes, for fastening pins to be plugged through the stop openings and the locking lugs and to be locked in the inserted position. In this way, the covering plate can be fixed on the connection pan element simply, quickly and reliably.

In order to give the connection pan element particularly great rigidity and durability, it can be reinforced by way of reinforcing ribs which are welded to its lateral bounding profiles; in the region of the reinforcing ribs, the locking bars can then be provided with cutouts, the width of which is dimensioned such that the reinforcing ribs which enter into them do not impede the pivotable mobility of the connection pan element relative to the receiving plate in the provided pivoting range of preferably up to ±5°.

These and other objects, aspects, features, developments and advantages of the invention of this application will become apparent to those skilled in the art upon a reading of the Detailed Description of Embodiments set forth below taken together with the drawings which will be described in the next section.

DETAILED DESCRIPTION OF EMBODIMENTS

Figure 1:
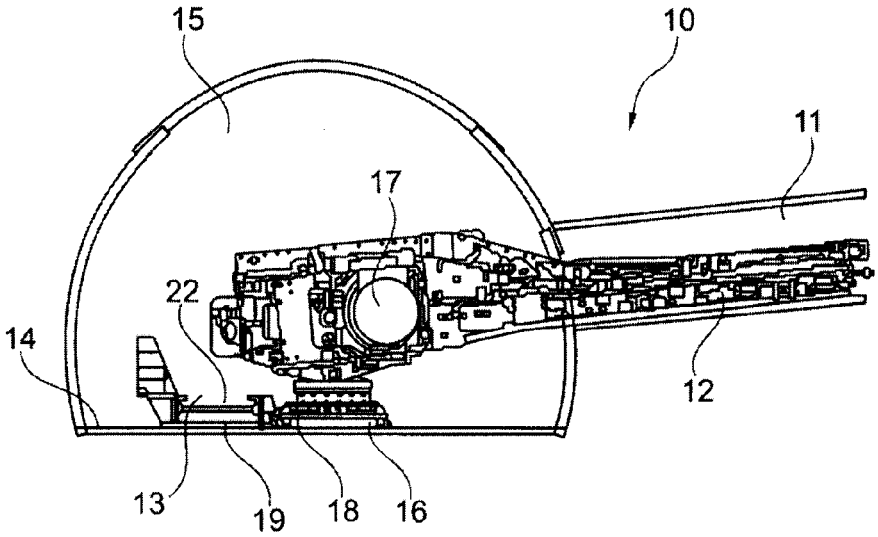
FIG. 1 shows a face end between a face conveyor and a gate conveyor in underground mining, in a side view.

Referring now to the drawings wherein the showings are for the purpose of illustrating preferred and alternative embodiments of the invention only and not for the purpose of limiting same, FIG. 1 shows a transfer station which is denoted in its entirety by 10 in the face end region between a face conveyor 12 which is arranged in an excavation longwall face 11 in underground mining and a gate conveyor 13 which is arranged on the footwall 14 of a gate 15, from which the excavation longwall face 11 branches off.

The transfer station 10 has a subframe 16 which supports the main drive 17 of the face conveyor. In so far as it has been described up to here, the transfer station corresponds to customary arrangements as are used in a versatile manner in underground mining, for example in coal extraction plants.

Figure 2:
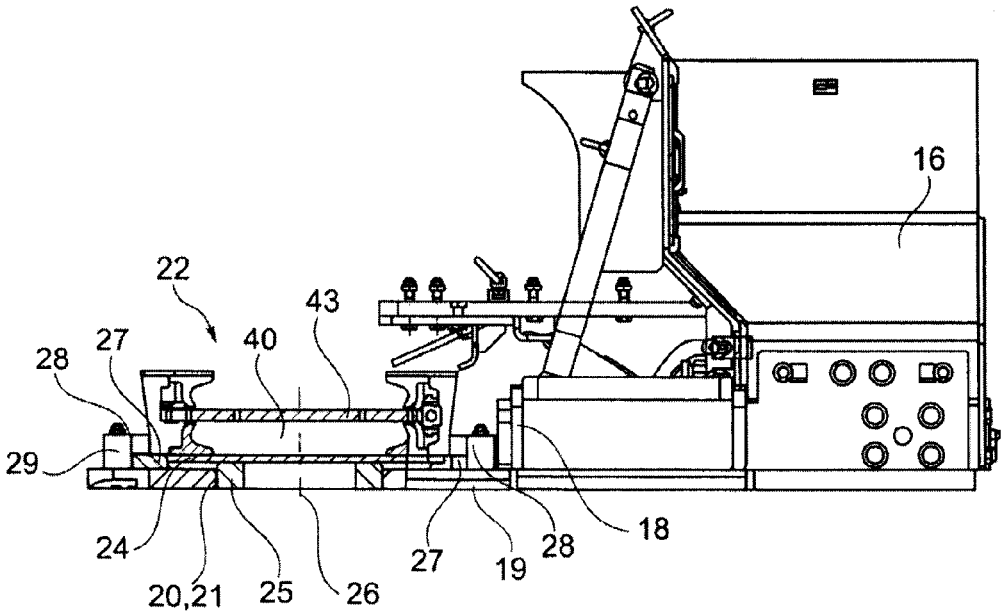
FIG. 2 shows a part of the subframe of the main drive of the face conveyor according to FIG. 1 in an enlarged illustration.
Figure 3:
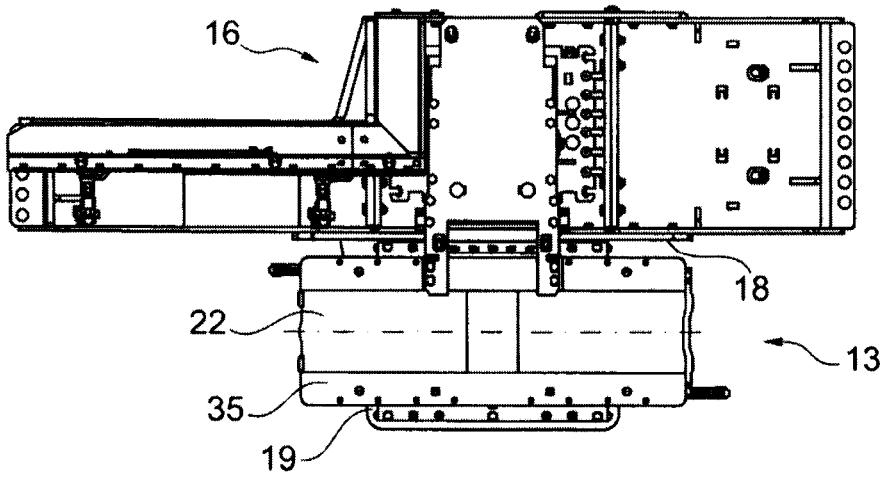
FIG. 3 shows the subframe according to FIG. 2 in a plan view.

It is seen from the further figures that the gate conveyor 13 is attached to the face conveyor 12 such that it can be moved pivotably to a limited extent relative to the latter. To this end, a receiving plate 19 which rests on the footwall 14 is attached fixedly to the subframe 16 on its outer side 18 which points toward the gate conveyor, the receiving plate 19 having a central, circular cutout 20 which forms a bearing seat 21 for a special connection pan element 22 of the gate conveyor 13. Said connection pan element 22, to which customary conveyor pans (not shown) of the gate conveyor which is configured in a manner known per se as an armored face conveyor are connected by way of customary locking bolt connections 23, has, on its underside 24, a bearing journal 25 which is adapted to the size of the bearing bore 20, is of annular configuration in the exemplary embodiment shown and engages with little play into the bearing seat 21, as can be seen satisfactorily, in particular, in FIGS. 2 and 5. This configuration allows it to be possible for the connection pan element to pivot sufficiently far to the left or right about the rotational axis 26 of the bearing seat, which rotational axis 26 is oriented substantially perpendicularly with respect to the footwall 14, in order to compensate for deviations from a right-angled arrangement of the two conveyors with respect to one another. At the same time, the positively locking engagement of the bearing journal on the underside of the connection pan element into the bearing seat which is provided in the receiving plate ensures that forces/movements in a direction at right angles to the rotational axis can be transmitted by the arrangement.

In order that unintentional raising of the bearing journal 25 out of the bearing bore 20 does not occur, the connection pan element 22 is secured in its position by way of an anti-raising safeguard. The anti-raising safeguard is formed substantially by two retaining flanges 27 which project laterally radially from the bearing journal on the longitudinal sides of the connection pan element 22 and are engaged over by locking bars 28 of approximately L-shaped cross section. The locking bars 28 are supported by way of their one, upright limb 29 on the upper side of the receiving plate 19 and are attached to the latter by way of fastening screws 30 which are plugged through holes 31 in the upright limbs 29 of the locking bars and are secured on the upper side by way of nuts 32. In order for it to be possible to readily exchange the fastening screws if required, keyhole-shaped receiving openings 33 are provided for them in the receiving plate, with the result that the fastening screws can be inserted from above with their screw head through the larger, cylindrical part of the keyhole receptacle and can then be displaced laterally, with the result that the screw head passes into the narrower region of the keyhole receptacle and finds an abutment there.

Figure 4:
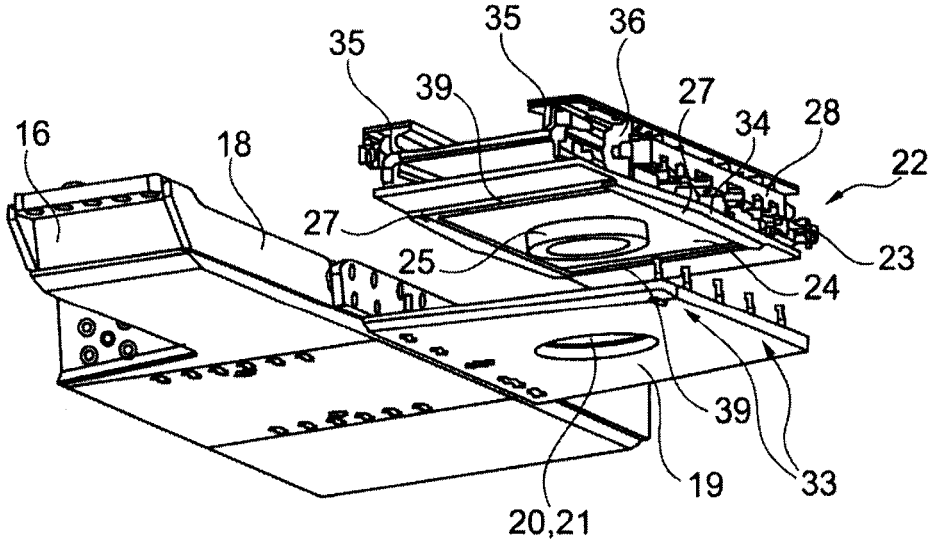
FIG. 4 shows the subject matter of FIGS. 2 and 3 in a perspective, partially exploded illustration obliquely from below.

It is seen, in particular, in FIG. 4 that the retaining flanges 27 which are formed laterally on the connection pan element have a central crown 34, from which they taper obliquely inward toward the two ends of the connection pan element, with the result that a pivotable mobility is ensured to the desired extent, approximately ±5% with respect to the longitudinal direction of the face conveyor, until the retaining flanges can come into contact with the upright limb 29 of the locking bars 28.

Figure 5:
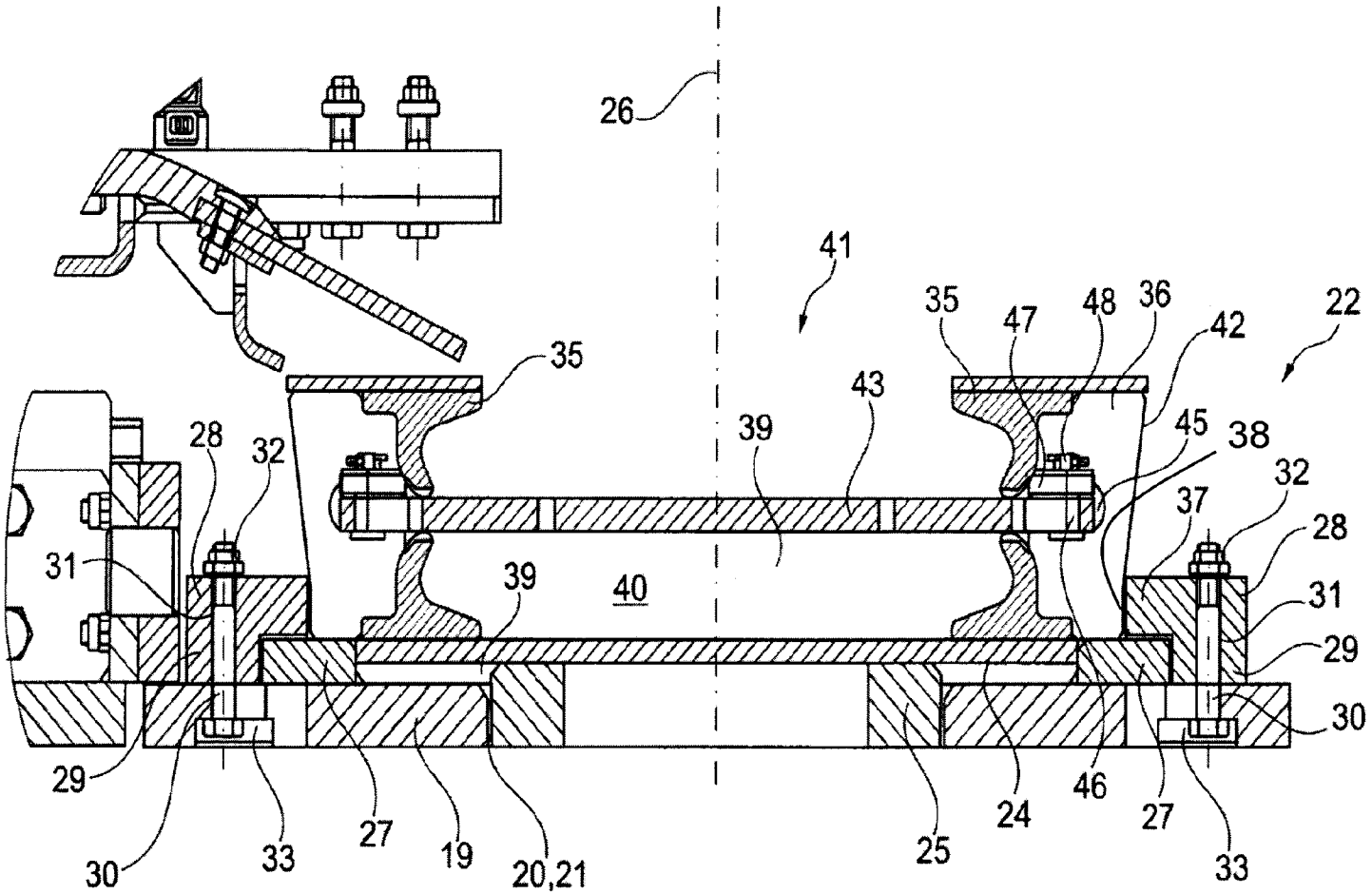
FIG. 5 shows an illustration of a detail V according to FIG. 2 in section.

Furthermore, it can be seen clearly in FIGS. 4 and 5 that the connection pan element 22 has lateral bounding profiles 35 on both sides, to the outer sides of which reinforcing ribs 36 are welded in order to reinforce the connection pan element. In order firstly not to restrict the pivotable mobility of the connection pan element, and secondly to achieve the best possible reinforcement by the ribs 36, the horizontal limbs 37 of the locking bars 28 are provided with cutouts 38 in the region of the reinforcing ribs 36, the width of which cutouts 38 in the longitudinal direction of the gate conveyor is dimensioned such that the reinforcing ribs 36 which engage into them do not impede the pivotable mobility of the connection pan element 22 relative to the receiving plate 19 in the provided pivoting region.

In order to further aid the rotational mobility of the connection pan element 22, the latter is provided on its underside 24 with support sliding elements 39 which are arranged spaced apart from the bearing journal 25 and are configured as support strips which extend transversely with respect to the longitudinal direction of the gate conveyor and by way of which the connection pan element 22 rests on the receiving plate 19 in a slidingly movable manner. The support sliding elements 39 can be composed of a particularly suitable bearing material which has a low coefficient of friction in combination with the material of the receiving plate and therefore ensures easy rotation of the connection pan element relative to the receiving plate. The sliding elements 39 can be arranged replaceably as wear and tear components on the connection pan element and can then be replaced by spare parts if required.

In order, even in the mounted state of the connection pan element 22, to provide ready access to the lower run 40 of the gate conveyor in the region of the transfer station and preferably also to the pivoting bearing which is situated underneath, the connection pan element 22 is provided with an inspection opening 41 which can be closed by means of a covering plate 43 which can be pushed in from an outer longitudinal side 42 of the connection pan element 22. The covering plate is guided in the manner of a drawer in lateral guide rails which are approximately V-shaped in section. Said covering plate is dimensioned such that, in the state in which it is mounted on the connection pan element 22, it protrudes on both sides beyond the lateral bounding profiles 35 of the pan element 22; it is provided at the protruding regions 45 with stop openings 46 which, in the mounted state, are aligned with locking lugs 47 which are formed on the bounding profiles 35, fastening pins 48 being plugged for locking purposes through the stop openings 46 and the locking lugs and being locked in the inserted position.

The invention provides a structurally simple and inexpensive, and nevertheless very highly reliable, pivotably movable connection between the face conveyor and the gate conveyor, by way of which connection angular deviations from a right-angled orientation of the two conveyors relative to one another are compensated for substantially automatically in a sufficiently great range. Here, the pivoting bearing is readily accessible and the forces which are to be transmitted by the pivoting bearing remain low, since the supporting forces which result from the weight of the main drive of the face conveyor are dissipated into the footwall by the subframe which is arranged laterally next to the receiving plate.

Further, while considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

The invention claimed is:

1. A transfer station for use between a face conveyor having an associated drive and a gate conveyor where the gate conveyor includes at least one connection pan element and is attached to the face conveyor such that the gate conveyor is pivotably movable relative to the face conveyor, the transfer station comprising:

a receiving plate arranged on a subframe of the associated drive of the face conveyor;

a bearing seat coupled to the receiving plate and defining a pivot axis;

wherein the connection pan element of the gate conveyor is mounted in the bearing seat such that it is pivotably movable relative to at least one of the face conveyor or the associated drive of the face conveyor about the pivot axis defined by the bearing seat.

2. The transfer station as claimed in claim 1, wherein the bearing seat is formed substantially by a bearing bore which is formed in the receiving plate and into which a bearing journal engages which is arranged on an underside of the connection pan element.

3. The transfer station as claimed in claim 2, wherein the connection pan element which is mounted on the receiving plate is secured to prevent the bearing journal from raising out of the bearing bore.

4. The transfer station as claimed in claim 2, wherein the connection pan element is provided with at least one retaining flange which projects radially from the bearing journal and is engaged by a locking bar which is releasably arranged on the receiving plate.

5. The transfer station as claimed in claim 2, wherein the at least one retaining flange has a central crown, from which the at least one retaining flange tapers obliquely inward.

6. The transfer station as claimed in claim 5, wherein the locking bar is fastened releasably to the receiving plate.

7. The transfer station as claimed in claim 6, wherein the locking bar is fastened releasably to the receiving plate by a plurality of fasteners that are attachable to keyhole receptacles on the receiving plate, the plurality of fasteners penetrating the locking bar and clamping the locking bar against the receiving plate by a corresponding plurality of closing nuts.

8. The transfer station as claimed in claim 2, wherein the connection pan element includes an underside provided with support sliding elements which are spaced apart from the bearing journal.

9. The transfer station as claimed in claim 8, wherein the support sliding elements include support strips which extend transversely with respect to a longitudinal direction of the gate conveyor, so that the connection pan element rests in a slideably manner on the receiving plate.

10. The transfer station as claimed in claim 4, wherein the connection pan element comprises an inspection opening and a covering plate.

11. The transfer station as claimed in claim 10, wherein the covering plate is guided laterally in guide rails.

12. The transfer station as claimed in claim 11, wherein the guide rails are generally V-shaped in section.

13. The transfer station as claimed in claim 10, wherein the covering plate projects beyond the connection pan element and is provided with stop openings, and wherein laterally projecting locking lugs which are aligned with the stop openings are arranged on the connection pan element for fastening pins to be inserted through the stop openings and the locking lugs and to be locked.

14. The transfer station as claimed in claim 13, wherein the connection pan element is reinforced by reinforcing ribs welded to lateral bounding profiles of the connection pan element, and in the region of the reinforcing ribs, the locking bar being provided with cutouts, the width of which are dimensioned such that the reinforcing ribs which enter into the cutouts do not impede the pivotable mobility of the connection pan element relative to the receiving plate.

15. The transfer station as claimed in claim 1, wherein a pivoting range of motion for the connection pan element is within a range of up to about ±5°.

16. A transfer station configured to interface between a face conveyor and a gate conveyor for mining, the transfer station comprising:

a subframe configured to support the face conveyor;

a receiving plate having a bearing seat, the receiving plate coupled to the subframe;

a pan connection element having an underside with a bearing journal, the bearing journal pivotally received in the bearing seat, the pan connection element configured to pivotally support the gate conveyor on the receiving plate, so that gate conveyor and the face conveyor are coupled to one another in a pivotal relationship.

17. The transfer station as claimed in claim 16, wherein the connection pan element is provided with at least one retaining flange which is engaged by a locking bar which is releasably arranged on the receiving plate.

18. The transfer station as claimed in claim 17, wherein the at least one retaining flange has a central crown, from which the retaining flange tapers obliquely inward so that a range of pivotal motion between the gate conveyor and the face conveyor is defined by a space created by the taper between the retaining flange and the locking bar.

19. The transfer station as claimed in claim 16, wherein the underside of the connection pan element includes support sliding elements which are spaced apart from the bearing journal so that the connection pan element rests in a slideably manner on the receiving plate.

20. A transfer station for coupling between a face conveyor and a gate conveyor for mining, the transfer station comprising:

a subframe coupled to the face conveyor;

a receiving plate having a bearing seat and at least one releasable locking bar, the receiving plate coupled to the subframe;

a pan connection element coupled to the gate conveyor, the pan connection element having an underside with a bearing journal and at least one retaining flange having a taper, the bearing journal received in the bearing seat for pivoting movement within a pivot range and the retaining flange engaged by the locking bar, so that a range of pivotal motion between the pan connection element and the receiving plate is defined by a space created by the taper between the retaining flange and the locking bar.

* * * * *

UNITED STATES PATENT AND TRADEMARK OFFICE

CERTIFICATE OF CORRECTION

PATENT NO. : 8,733,536 B2
APPLICATION NO. : 13/509034
DATED : May 27, 2014
INVENTOR(S) : Klabisch et al.

It is certified that error appears in the above-identified patent and that said Letters Patent is hereby corrected as shown below:

In the Specification

Column 2, line 11, delete “convection” and insert -- connection --.

In the Claims

Column 5, line 67, in Claim 1, delete “conveyor where” and insert -- conveyor, where --.

Column 6, line 28, in Claim 5, delete “claim 2,” and insert -- claim 4, --.

Signed and Sealed this
Fifteenth Day of September, 2015

Michelle K. Lee

Michelle K. Lee
*Director of the United States Patent and Trademark Office*